United States Patent [19]

Zlupko

[11] 3,982,048

[45] Sept. 21, 1976

[54] METHOD OF MAKING AN INSULATOR WITH A NON-LINEAR RESISTIVITY COATING OF GLASS BONDED SILICON CARBIDE

[75] Inventor: John E. Zlupko, Philadelphia, Pa.

[73] Assignee: General Electric Company, Philadelphia, Pa.

[22] Filed: Nov. 3, 1975

[21] Appl. No.: 628,033

[52] U.S. Cl. ..... 427/126; 106/52; 106/54; 252/516; 427/376 A

[51] Int. Cl.[2] ..... B05D 5/12

[58] Field of Search ..... 427/101, 126, 376 A; 106/52, 54; 252/516

[56] References Cited

UNITED STATES PATENTS

| | | | |
|---|---|---|---|
| 3,291,759 | 12/1966 | Pitha | 252/516 |
| 3,509,072 | 4/1970 | Barrington et al. | 252/516 |
| 3,573,231 | 3/1971 | Subramanya et al. | 252/516 |
| 3,791,859 | 2/1974 | Hirayama | 428/428 |

*Primary Examiner*—Cameron K. Weiffenbach
*Attorney, Agent, or Firm*—William Freedman; J. Wesley Haubner

[57] ABSTRACT

This method of making a ceramic insulator with a stress-grading coating comprises applying to a ceramic body a coating material comprising particles of silicon carbide and a binder comprising a high-silica glass or high-silica glass-forming material, said glass or glass-forming material having a fusion temperature in the range of 1850° F to 2350° F. The coated ceramic body is fired in an argon atmosphere at a temperature in the range of 1850° F to 2350° F to form on the ceramic body a glaze coating that has non-linear resistivity properties.

6 Claims, 2 Drawing Figures

SiC AND A HIGH-SILICA GLAZE HAVING A FUSION TEMPERATURE IN THE RANGE OF 1850°F TO 2350°F

METHOD OF MAKING AN INSULATOR WITH A NON-LINEAR RESISTIVITY COATING OF GLASS BONDED SILICON CARBIDE

BACKGROUND

This invention relates to a method of making a ceramic insulator having a non-linear resistivity, stress-grading coating comprising particles of silicon carbide bonded with a glass.

It is proposed in U.S. Pat. No. 3,791,859-Hirayama to produce such insulators by providing a mixture of silicon carbide particles and glass particles, coating a ceramic body with this mixture, and firing the coated ceramic body. If the glass of this mixture is the usual glazing material for insulators, firing must be carried out at temperatures of 1850° F or more. According to the Hirayama patent, firing at this high temperature can produce a reaction between the glass and the silicon carbide that causes bubbles or blisters to form which distort the surface of the insulator. To avoid this problem, Hirayama uses for his binder a low fusion-temperature glass having a fusion temperature of less than 850° C (or 1562° F). Such low fusion-temperature glass is more expensive than the usual glaze that is used for coating ceramic insulators and is not as durable as the usual glaze under adverse weather conditions. Moreover, the usual glaze has a long-standing proven record of compatibility with porcelain (e.g., in terms of relative thermal expansion coefficients contributing to increased mechanical strength of the overall insulator), which record the low fusion-temperature glasses do not have, insofar as I am aware.

SUMMARY

An object of my invention is to provide for a ceramic insulator a glass-bonded silicon carbide coating applied in such a manner that conventional high-fusion-temperature glass can be used in the coating without forming blisters or bubbles during firing of the coating at temperatures of 1850° F. or higher.

In carrying out my invention in one form, I provide a mixture of silicon carbide particles and a binder for said particles comprising a high-silica glass or a high-silica glass-forming material, said glass or glass-forming material having a fusion temperature in the range of 1850° to 2350° F. I apply this mixture to a ceramic body to form a coating thereon. The coated ceramic body is then fired in an inert gaseous atmosphere such as argon at a temperature in the range of 1850° to 2350° F. The resulting coating is substantially free of blisters and bubbles and has non-linear resistivity properties.

The term, fusion temperature, as used herein in reference to glass or glass-forming materials applied in particle form to a substrate of porcelain or alumina and then fired, is intended to denote the minimum temperature at which the particles fuse together during firing to form a homogeneous vitreous layer that is fused to the substrate. Typically, this temperature will be several hundred degrees F. above the softening point of the glass or glass-forming material.

BRIEF DESCRIPTION OF DRAWING

For a better understanding of the invention, reference may be had to the following description taken in connection with the accompanying drawing, wherein.

DETAILED DESCRIPTION OF PREFERRED EMBODIMENTS

Figure 1:
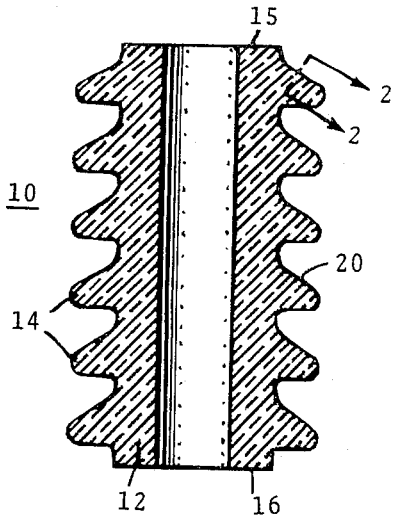
FIG. 1 is a sectional view of an insulator made in accordance with the method of my invention.

Referring now to FIG. 1, there is shown an outdoor insulator 10 comprising a tubular ceramic body 12, preferably of porcelain or alumina, having conventional petticoats 14 longitudinally spaced along its outer surface. In a typical application, a high voltage will be present between opposite ends 15 and 16 of the insulator, and this voltage will be distributed along the outer surface of the insulator. In many such insulator applications, such as in a lead-in bushing, this voltage distribution will normally be rather non-uniform.

Figure 2:
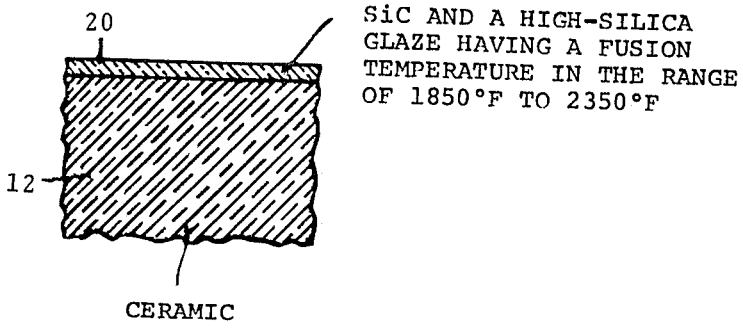
FIG. 2 is a sectional view along the line 2—2 of FIG. 1.

For producing a more uniform voltage distribution along this outer surface, I form the surface from a glaze coating having non-linear resistivity properties, i.e., resistivity that varies inversely and non-linearly as a function of the applied voltage. This coating is shown at 20 in the sectional view of FIG. 2.

I apply this coating to the porcelain insulator body 12 after the insulator body has been fired. The coating material is prepared by mixing silicon carbide particles with particles of a conventional insulator glazing material, such as a glass that in one embodiment has the following composition:

| Constituent | Percent Composition by Weight |
|---|---|
| $Na_2O$ | 2.81 |
| $K_2O$ | 1.10 |
| CaO | 6.92 |
| PbO | 3.49 |
| $Al_2O_3$ | 5.61 |
| $B_2O_3$ | 24.21 |
| $SiO_2$ | 55.86 |

This glazing material, which is available from P. F. O'Hommel Co. of Pittsburgh, Pennsylvania, as its No. 576 Glass Frit, has a fusion temperature of about 2000° F. Its softening point is about 1680° F. to 1700° F. Its particle size is about 325 mesh.

EXAMPLE NO. 1

In one specific example, the coating material had the following composition:

| | | |
|---|---|---|
| No. 576 Glass Firt | - 75 | gms. |
| 600 mesh SiC particles | - 25 | gms. |
| Bentonite clay | - 4 | gms. |
| Sodium silicate | - 6.5 | gms. |

This material was added to distilled water and mixed therein by suitable means, such as a ball mill, for approximately 6 ½ hours to prepare a thoroughly mixed suspension for application to the insulator body. This suspension was then applied to the surface of the already-fired porcelain body 12, preferably by spraying or dipping, after which the suspension was allowed to air dry into a hard coating. Upon firing, any residual liquid was driven off, and the glass frit, the Bentonite clay, and the sodium silicate reacted and melted to form a molten glass that bound together the particles of silicon carbide. This silicon carbide and glass coating was fired onto the porcelain insulator body at a temperature of about 2000° F. for approximately ½ hour. Most importantly, the firing operation was performed in an inert atmosphere, argon.

The prior art referred to hereinabove indicates that silicon carbide and the usual insulator glazing materials will react with each other at typical firing temperatures such as I use to form bubbles and blisters on the insulator surface. I have found, however, that if the firing is performed in an inert atmosphere such as argon, no significant bubbles or blisters are formed at typical firing temperatures in the range of 1850° F to 2350° F during the required firing times.

The silicon carbide particles used should have a size between 400 and 650 mesh. Larger particles result in poor reproducibility and low breakdown voltages. The percentage by weight of the silicon carbide particles to that of the overall coating material can be varied to vary the nonlinearity characteristics of the coating. I prefer, however, to use between 10 and 30 percent silicon carbide by weight to that of the overall coating material. In Example No. 1 above, the SiC particles constitute about 21.7 percent by weight of the overall coating material.

The non-linearity of a non-linear resistance material is typically expressed in terms of a non-linearity index n. This index is determined by measuring leakage current I through the material when different values of voltage V are applied thereto. Leakage current I is related to applied voltage V by the following equation, where $k$ is a constant:

$$I = k\ V^n$$

This index n varies for different coating thicknesses. With a nominal coating thickness of 0.003 inches, using the particular material referred to in this first example, n was found to be 1.97. Using the same material with a nominal coating thickness of 0.0015, n was found to be 2.54.

In the specific coating material described above, the sodium silicate constituent serves as a deflocculating agent in the suspension, making the coating material more fluid and easier to apply. The presence of this constituent is not crucial, and a much smaller percentage of this constituent can be used if desired, as will be apparent from Example No. 2 hereinbelow. As a matter of fact, it is even possible to omit this constituent altogether if more care can be taken in mixing the ingredients of the coating material.

In the specific coating material described above, the Bentonite clay serves to enhance the attachment of the coating to the ceramic body before firing and to improve the durability of the pre-fired coating.

EXAMPLE NO. 2

In another embodiment of the invention the coating material had the following composition:

| | | |
|---|---|---|
| No. 576 Glass Frit | - 75 | gms. |
| 600 mesh SiC particles | - 13 | gms. |
| Bentonite clay | - 4 | gms. |
| Sodium silicate | - 0.5 | gms. |

This material was mixed in distilled water, applied to the insulator surface by spraying, air dried, and then fired, all in substantially the same manner as described in Example No. 1. The resulting coating, with a nominal thickness of 0.001 inches, had a non-linearity index n of 1.90. In this example, the SiC particles constitute about 14 percent by weight of the overall coating material.

EXAMPLE NO. 3

In another embodiment of the invention, the glazing, or glass-forming, material consisted of the following raw materials, in thoroughly-mixed particle form, as ingredients:

| Ingredients | Percentage Composition by Weight |
|---|---|
| Ball clay ($Al_2O_3 . SiO_2 . 2H_2O$) | 16.3 |
| Whiting ($CaCO_3$) | 15.3 |
| Feldspar ($Na_2O . SiO_2 . Al_2O_3$) | 38.0 |
| Flint ($SiO_2$) | 23.9 |
| Talc ($MgO . SiO_2$) | 3.3 |
| Zinc Oxide (ZnO) | 3.2 |

This is a conventional glazing material that when fused in the usual manner results in a glaze having a softening point of about 2000° F. This glazing material has a fusion temperature of about 2300° F. The particles of the glazing material used in this Example No. 3 had a size of about 325 mesh or smaller.

The glazing material of this Example 3 has the following composition:

| Ingredient | Percentage Composition by Weight |
|---|---|
| $Al_2O_3$ | 15.5 |
| $SiO_2$ | 63.5 |
| $Na_2O$ | 5.5 |
| CaO | 9.5 |
| MgO | 2.5 |
| ZnO | 3.5 |

This glazing material, while still consisting of its unfused raw materials in the above-described particle form, was combined with SiC particles in the following mixture:

| | | |
|---|---|---|
| Conventional glazing material referred to immediately above | - 80 | gms. |
| 500 mesh SiC particles | - 20 | gms. |

This mixture was suspended in water and mixed for approximately 30 minutes. Thereafter the suspension was applied to the surface of the porcelain body by spraying, then allowed to air dry into a hard coating. The coated insulator was then fired in an atmosphere of argon at a temperature of about 2300° F for ½ hour. The resulting coating was smooth and substantially free of bubbles and blisters.

The non-linearity index of this coating was found to be about 2.75. The silicon carbide particles constitute 20 percent by weight of this coating material.

When the weight percentage of silicon carbide in my above-described coating materials exceeds about 30 percent, the resistance of the coating material becomes too low for use as a high-voltage insulator coating. In addition, a percentage of SiC greater than about 30 percent results in loss of the desired surface smoothness and a matte type finish which detracts from the water-shedding ability of insulator. For percentages of SiC less than about 10 percent, the resistivity of the coating becomes too high for my high voltage insulator application.

The firing temperature used for applying my coating should be well above the softening point of the glaze, e.g., a few hundred degrees F above the softening point. This higher temperature is needed to effect good wetting of the substrate, subsequent fusion thereto, and formation of a continuous well-bonded glaze.

My above-described glaze coatings are highly resistant to moisture and corrosion and thus require no overglaze to protect them even from severe weather conditions. Thus, only a single firing is necessary to provide the insulator body with a glaze coating having the desired weatherresistant non-linear resistivity properties.

In referring herein to a high-silica glaze, I am referring to a glaze having greater than 30 percent silica by weight. The two different glazes used as binders in the above examples are in this category.

Our coating is especially well suited to use with an insulator body of electrical porcelain or alumina because the coating material has a coefficient of thermal expansion approximately matching but still slightly less than that of electrical porcelain or alumina. In this respect, the two glaze materials referred to hereinabove, considered without the silicon carbide additive, have a coefficient of thermal expansion of about 5 to $5.5 \times 10^{-6}$ inches/° C at temperatures between 0° and 250° C, whereas at these same temperatures wet process, or electrical, porcelain has a coefficient of about $6.5 \times 10^{-6}$ inches/° C and alumina has a coefficient of about $7.25 \times 10^{-6}$ inches/° C. The addition of the above-described 10 to 30 weight percent of silicon carbide to the glazing material produces a slightly higher coefficient of thermal expansion in the composite material, but available evidence indicates that the resulting coefficient is still slightly below that of the porcelain or alumina.

It is highly desirable that the coefficient of thermal expansion of the coating material be slightly less than that of the body 12 because this results in the glaze being loaded in compression when the glazed insulator cools after having been fired. The presence of this compressive force in the glaze coating contributes to increased tensile strength for the overall insulator.

While I have described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. A method of making an electrical insulator comprising:

a. providing a ceramic body, b. providing a non-linear resistivity coating material comprising particles of silicon carbide having a particle size of 400–650 mesh and a binder for said particles comprising a glass or a glass-forming material having a fusion temperature in the range of 1850° F to 2350° F, said silicon carbide particles being present in said coating material in a percentage of 10 to 30 percent by weight of said coating material, c. applying said coating material to said ceramic body to form a thin coating thereon, d. firing said coated ceramic body at a temperature in the range of 1850° F to 2350° F in an inert gaseous atmosphere to form on said ceramic body a glaze coating that has non-linear resistivity properties.

2. The method of claim 1 in which said inert gaseous atmosphere consists essentially of argon.

3. The method of claim 2 in which said binder contains at least 30 percent silica by weight.

4. The method of claim 3 in which said binder comprises $SiO_2$, $B_2O_3$, $Al_2O_3$, and CaO.

5. The method of claim 3 in which said binder comprises $SiO_2$, $Al_2O_3$, and CaO.

6. The method of claim 1 in which the glaze resulting from said firing operation has a coefficient of thermal expansion approximating but slightly lower than that of the ceramic of said ceramic body.

* * * * *